US012150547B1

(12) United States Patent
Church

(10) Patent No.: US 12,150,547 B1
(45) Date of Patent: Nov. 26, 2024

(54) PORTABLE RAIL SHELF SYSTEM AND METHOD OF ATTACHMENT TO A RAIL

(71) Applicant: Raymond E Church, Aston, PA (US)

(72) Inventor: Raymond E Church, Aston, PA (US)

( * ) Notice: Subject to any disclaimer, the term of this patent is extended or adjusted under 35 U.S.C. 154(b) by 0 days.

(21) Appl. No.: 18/614,434

(22) Filed: Mar. 22, 2024

(51) Int. Cl.
*A47B 5/02* (2006.01)
*A47K 10/22* (2006.01)

(52) U.S. Cl.
CPC ..... *A47B 5/02* (2013.01); *A47K 10/22* (2013.01)

(58) Field of Classification Search
CPC ..... A47B 5/02; A47K 10/22
USPC ..... 108/152, 108
See application file for complete search history.

(56) References Cited

U.S. PATENT DOCUMENTS 1,064,843 A * 6/1913 Marsh ..... A47B 96/061 108/152
3,556,306 A * 1/1971 Shell ..... A47B 96/021 211/187
4,074,635 A * 2/1978 Stauble ..... A47B 96/027 110/259
4,889,057 A * 12/1989 Chartrand ..... A47B 85/04 108/42
5,044,285 A * 9/1991 Wolfe, III ..... A47B 96/066 211/90.01
6,931,998 B1 8/2005 Leese
8,561,550 B2 * 10/2013 Raml ..... A47B 5/00 108/42
8,857,347 B1 * 10/2014 Liu ..... A47B 5/02 108/47
8,915,197 B2 * 12/2014 Raml ..... A47B 37/04 108/42
9,259,080 B1 2/2016 Knight
9,814,305 B2 * 11/2017 Brus ..... A47G 7/044
10,123,614 B2 * 11/2018 Trujillo ..... A47B 5/00
10,330,256 B2 * 6/2019 Eckhart ..... B25H 3/00
10,617,209 B1 4/2020 Frost
10,660,432 B2 * 5/2020 Trujillo ..... A47B 5/04
11,891,811 B2 * 2/2024 Warner ..... E04F 13/0871
2007/0101908 A1 * 5/2007 Makita ..... A47B 5/02 108/47
2009/0020047 A1 1/2009 Noble et al.
2016/0353877 A1 12/2016 Brus et al.
2020/0113324 A1 4/2020 Estrada

* cited by examiner

*Primary Examiner* — Daniel J Troy
*Assistant Examiner* — Timothy M Ayres

(57) ABSTRACT

A portable rail shelf system includes a portable rail shelf that is detachably attachable to a rail. A portable rail shelf includes a pair of shelf side panels, a shelf front panel, a shelf back panel and a shelf panel having a shelf surface. The portable rail shelf is configured to couple to a rail having vertical slats. A retainer plate is coupled to the portable rail shelf by a bolt that threadedly engages with a shelf bolt receiver. Rotation of the shelf bolt receiver is configured to actuate the retainer bolt and the retainer bolt coupled thereto. A paper towel roll may be coupled to the portable rail shelf by a dowel that extends through shelf side apertures in the shelf side panels.

12 Claims, 7 Drawing Sheets

PORTABLE RAIL SHELF SYSTEM AND METHOD OF ATTACHMENT TO A RAIL

BACKGROUND OF THE INVENTION

Field of the Invention

The invention relates a portable rail shelf system that is detachably attachable to a rail.

Background

Many backyards have fences, patios and/or porches with railings extending around the patio or porch. The top rail of a fence or railing is typically narrow, and sometimes crowned, which is not conducive to placing items, such as a beverage container or plates, thereon. There is a need for a quick and easy way to attach a shelf to a fence or railing having slats, including composite and wooden fences.

SUMMARY OF THE INVENTION

An exemplary portable rail shelf system includes a portable rail shelf that is detachably attachable to a rail. A portable rail shelf includes a pair of shelf side panels, a shelf front panel, a shelf back panel and a shelf panel having a shelf surface. The portable rail shelf is configured to couple to a rail having vertical slats. A retainer plate is coupled to the portable rail shelf by a bolt that threadedly engages with a shelf bolt receiver. Rotation of the shelf bolt receiver is configured to actuate the retainer bolt and the retainer bolt coupled thereto. A paper towel roll may be coupled to the portable rail shelf by a dowel that extends through shelf side apertures in the shelf side panels.

The portable rail shelf includes a shelf panel that extends over shelf side panels and a shelf front panel. The shelf panel has a width of about 0.2 m or more, about 0.3 m or more, about 0.4 m or more, about 0.5 m or more, about 0.75 m or more, about 1 m or less and any range between and including the widths provided. The shelf panel may have a depth of about 0.1 m or more, about 0.2 m or more, about 0.3 m or more, about 0.4 m or more, about 0.5 m or less and any range between and including the depths provided. The shelf panel may extend from the side panels an overhang distance of about 2 cm or more, about 5 cm or more, about 10 cm or more, about 20 cm or more, about 25 cm or more, about 40 cm or more and any range between and including the values provided. A larger overhang distance may enable the portable rail shelf to be used as a bar or table with a chair or stool being pulled up to or under the portable rail shelf. The shelf panel has a shelf surface side, or top side with the portable rail shelf coupled to a rail that may be planar. The shelf panel may have a back stop extending along the back side to prevent items from falling or sliding off the back of the shelf panel. Alternatively, a shelf back panel may extend up from the shelf surface of the shelf panel a back extension height. The back extension height of a back stop or shelf back panel may be about 0.5 cm or more, about 1 cm or more, about 2 cm or more, about 5 cm or more, about 10 cm or more, about 20 cm or more and any range between and including the height values provided.

A shelf back panel may have a width and/or a height of about 0.2 m or more, about 0.3 m or more, about 0.4 m or more, about 0.5 m or more, about 0.75 m or more, about 1 m or less and any range between and including the values provided. The width of the shelf back panel may be less than the width of the shelf panel.

An exemplary retainer plate has a length that is effectively long to extend across the slat opening and over the slat retainer plate slide of adjacent slats. A retainer plate may have a length of about 20 cm or more, about 30 cm or more, about 40 cm or more about 50 cm or more and any range between and including the length values provided. It may be desirable for the length of the retainer plate to be less than the width of the portable rail shelf or the shelf panel. A width of the retainer plate may be less than a slat opening and therefore may be no more than about 20 cm, no more than about 10 cm, no more than about 8 cm and any range between and including the width provided. Some jurisdictions have a code for fence openings between slats of no more than 4 inches or about 10 cm. The exemplary retainer plate as shown is an elongated member having a length that is more than three times the length.

The retainer plate of the portable rail shelf system is coupled to the portable rail shelf by a retainer bolt that extends through a shelf bolt aperture in the shelf back panel. The retainer bolt has a retainer bolt head on the bolt head side of the retainer plate. A bolt head plate may be configured between the bolt head and the bolt head side of the retainer plate to prevent the bolt head from digging into the retainer plate. The bolt head plate may be metal and the retainer plate may be wood or plastic or a softer material than the bolt head plate. The retainer bolt extends from the rail side of the shelf back panel and into the interior of the portable rail shelf. The retainer bolt is actuated by a shelf bolt receiver, wherein rotation of the shelf bolt receiver actuates the retainer bolt toward the portable rail shelf to clamp the retainer plate to slats of the rail. The retainer plate may be configured to rotate such that it can be rotated for passage through adjacent vertical slats. Subsequently the retainer plate may be rotated such that it extends across the adjacent slats. The retainer plate may be rotated or the portable rail shelf with the retainer plate attached may be rotated to orient the retainer plate for passage through the adjacent slats. The retainer plate may be configured substantially horizontal or orthogonal to the length of the slats or within about 40 degrees, or within about 20 degrees of horizontal or orthogonal to the length of the slats. A horizontal retainer plate may more effectively engage with the vertical slats to secure the portable rail shelf to the rail.

A shelf bolt receiver has receiver threads and receives the retainer bolt and engages with the bolt threads, such that rotation of the shelf bolt receiver actuates the bolt. A clockwise rotation of the shelf bolt receiver, as seen from the front of the portable rail shelf, will actuate the retainer bolt toward the shelf back panel to clamp the portable rail shelf to a rail and counter-clockwise of the shelf bolt receiver, as seen from the front of the portable rail shelf, will actuate the retainer bolt away from the shelf back panel to release the portable rail shelf from the rail. The shelf bolt receiver may have a tightening feature, such as an extension from the shelf bolt receiver to reduce the torque required to turn the shelf bolt receiver. The tightening feature may include a high friction surface to further aid in rotating the shelf bot receiver without slipping.

The retainer bolt has a bolt head that may be configured on the bolt head side of the retainer plate and a bolt extension that extends through the plate bolt aperture, through the shelf bolt aperture in the shelf back panel to a bolt extended end. A bolt head plate may be configured between the bolt head and the bolt head side of the retainer plate. The bolt head may rotate with respect to the retainer plate. The bolt head may be attached to the retainer plate, wherein rotation of the bolt rotates the retainer plate. The bolt extended end is configured in the bolt receiver aperture of the shelf bolt receiver and engages with the receiver threads. The rotation of the shelf bolt receiver and the receiver threads actuates the retainer bolt and the retainer plate coupled thereto. Rotation of the shelf bolt receiver in a first direction, such as clockwise when viewed from the front of the portable rail shelf, actuates the retainer bolt toward the portable rail shelf or shelf back panel, and rotation of the shelf bolt receiver in a second direction, such as counter-clockwise when viewed from the front of the portable rail shelf, actuates the retainer bolt away from the portable rail shelf or shelf back panel, as indicated by the double ended arrow. In this way, the portable rail shelf system and the portable rail shelf is detachably attachable to a rail.

The shelf bolt receiver extends from a front end proximal to the shelf front panel, to a back end, proximal to the shelf back panel. A front slip plate and back slip plate prevent the shelf bolt receiver from sticking to the shelf front and back panels and aids in ease of rotation. A back slip plate may be a low friction material.

The portable rail shelf system may include a retainer extension that extends from the retainer plate and into or through a retainer extension aperture in the shelf back panel to the retainer extended end to prevent the portable rail shelf from rotating with respect to the retainer plate. The retainer extended end may be configured within the shelf interior or from the rail side past the shelf side of the shelf back panel. The retainer extension may be detachably attachable to the retainer plate.

The shelf panel may include a shelf flange that extends from the flange surface of the shelf panel. The shelf flange may have a front extension portion configured to abut against the shelf front panel and may have two side extension portions configured to abut against the shelf side panels. The shelf flange may fit within the shelf interior, or inside of the shelf front and shelf side panels. The shelf flange may have a back extension that abuts the shelf back panel. The shelf panel may be configured to detach from the portable rail shelf and may simply lift off from the portable rail shelf.

A portable rail shelf system is configured to detachably attach to a rail, a support of a railing around a porch, patio, or balcony and also a rail of a fence, such as horizontal or vertical slats of a railing or fence.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
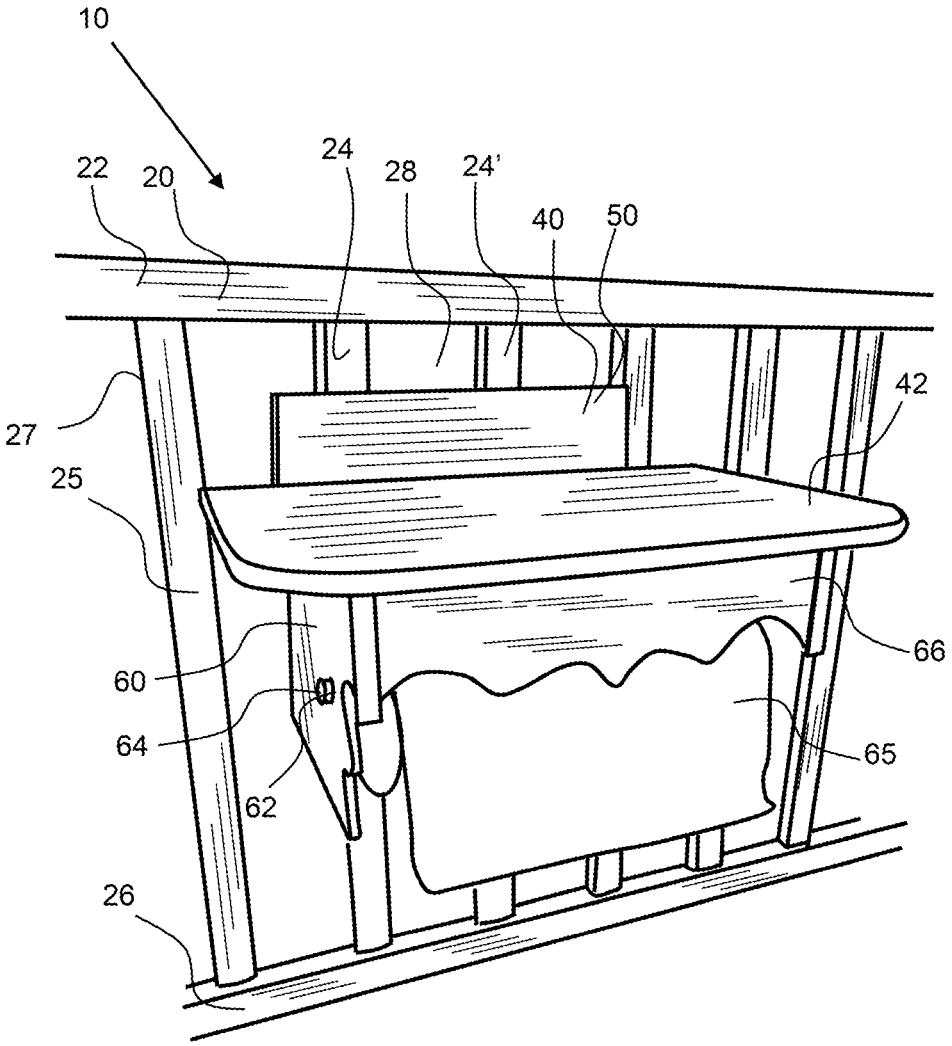
FIG. 1 shows a perspective view of an exemplary portable rail shelf system with the portable rail shelf detachably attached to the slats of rail and with a paper towel roll retained on a dowel extending through a shelf side aperture.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be an included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
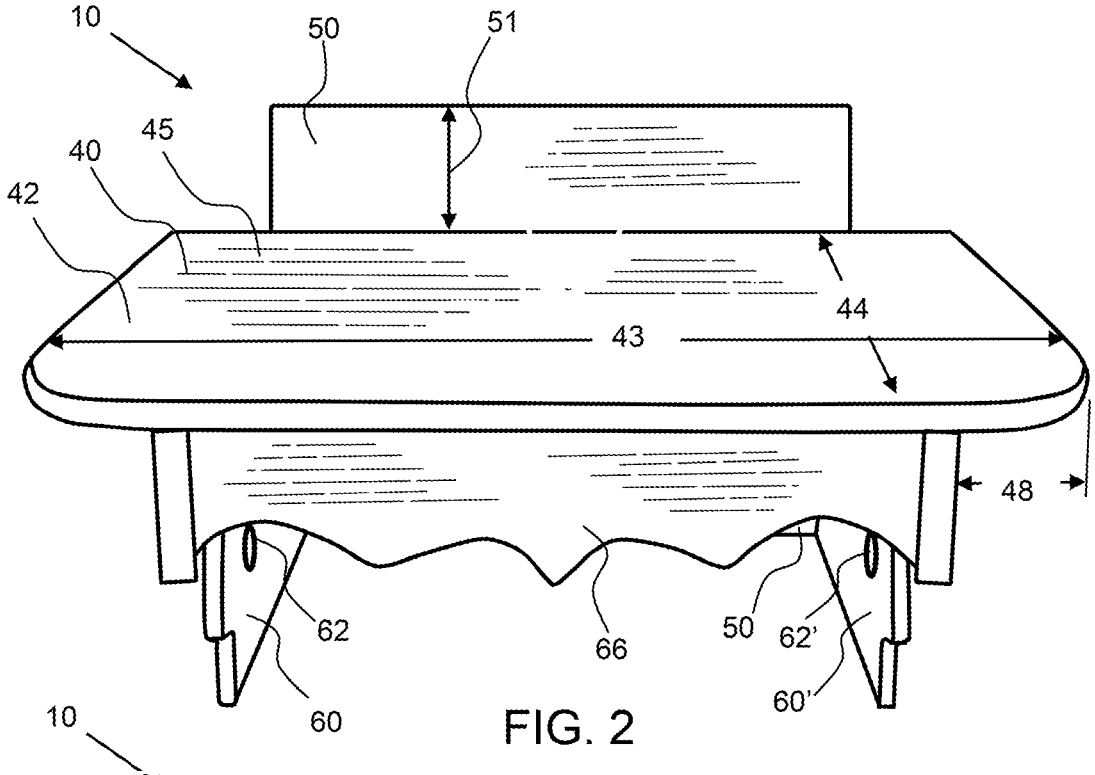
FIG. 2 shows a front view of an exemplary portable rail shelf system with the portable rail shelf including side panels, a front panel, a back panel and a shelf panel extending over the side and front panels and with the back panel extending up a back extension height from the shelf surface.
Figure 3:
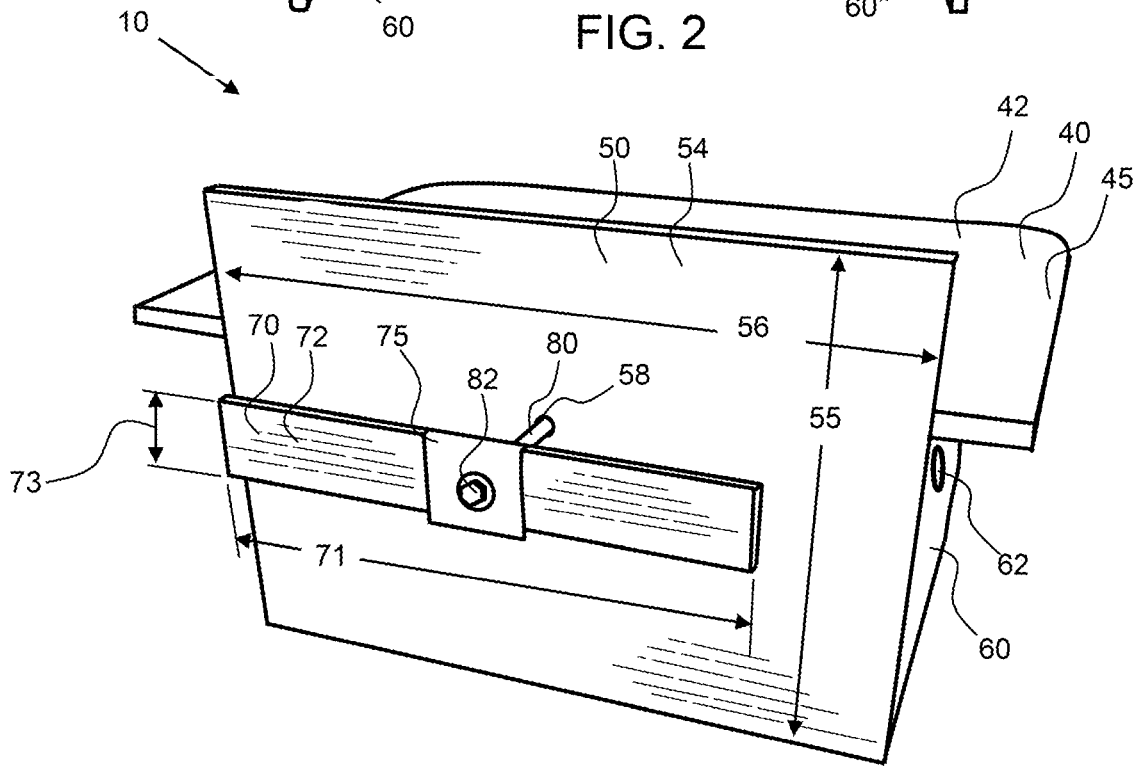
FIG. 3 shows a back perspective view of an exemplary portable rail shelf system with a retainer plate coupled to the portable rail shelf by a retainer bolt.

Referring now to FIGS. 1 to 3, an exemplary portable rail shelf system 10 includes a portable rail shelf 40 including a pair of shelf side panels 60, 60', a shelf front panel 66, a shelf back panel 50 and a shelf panel 42 having a shelf surface. As shown in FIG. 1, the portable rail shelf 40 is coupled to a rail 20, wherein the rail has a top rail 22, slats 24, 24' and a bottom rail 26. There is a slat opening 28 between adjacent slats 24, 24' for receiving the retainer plate 70 therethrough. The portable rail shelf 40 is retained on the slat shelf side 25 of the rail 20 and the retainer plate 70 is extends across adjacent slats 24, 24' on the slat retainer plate side 27 of the rail 20. A paper towel roll 65 is coupled to the portable rail shelf 40 by a dowel 64 that extends through shelf side apertures 62 in the shelf side panels 60. The shelf panel 42 may extend substantially horizontal (within about 20 degrees and preferably within 10 degrees or less) with the portable rail shelf coupled to vertical slats of a rail.

As shown in FIG. 2, the shelf panel 42 extends over the shelf side panels 60, 60', the shelf front panel 66 and has a width 43 and depth 44. The shelf panel extends from the side panels an overhang distance 48. The shelf back panel 50 extends up from the shelf surface 45 (top surface when the portable rail shelf is attached to a rail) of the shelf panel 42 a back extension height 51. This back extension height may act as a stop to prevent items placed on the shelf from falling off the back of the portable rail shelf 40 and through the rail. The two shelf side panels 60, 60' with respective shelf side apertures 62, 62' are shown in FIG. 2.

As shown in FIG. 3, the portable rail shelf system 10 includes a retainer plate 70 that is coupled to the portable rail shelf 40 by a retainer bolt 80 that extends through a shelf bolt aperture 58. The retainer bolt 80 has a bolt head 82 on the bolt head side 72 of the retainer plate 70. A bolt head plate 75 is configured between the bolt head 82 and the bolt head side 72 of the retainer plate 70. The bolt extends from the rail side 54 of the shelf back panel 50. The shelf back panel 50 has a height 55 and width 56 that may be less than a width 43 of the shelf panel 42.

As shown in FIG. 3, the retainer plate has length 71 and a width 73. The exemplary retainer plate as shown is an elongated member having a length that is more than three times the length. The length of the retainer plate may be effectively long to extend across the slat opening and over the slat retainer plate slide of adjacent slats.

Figure 4:
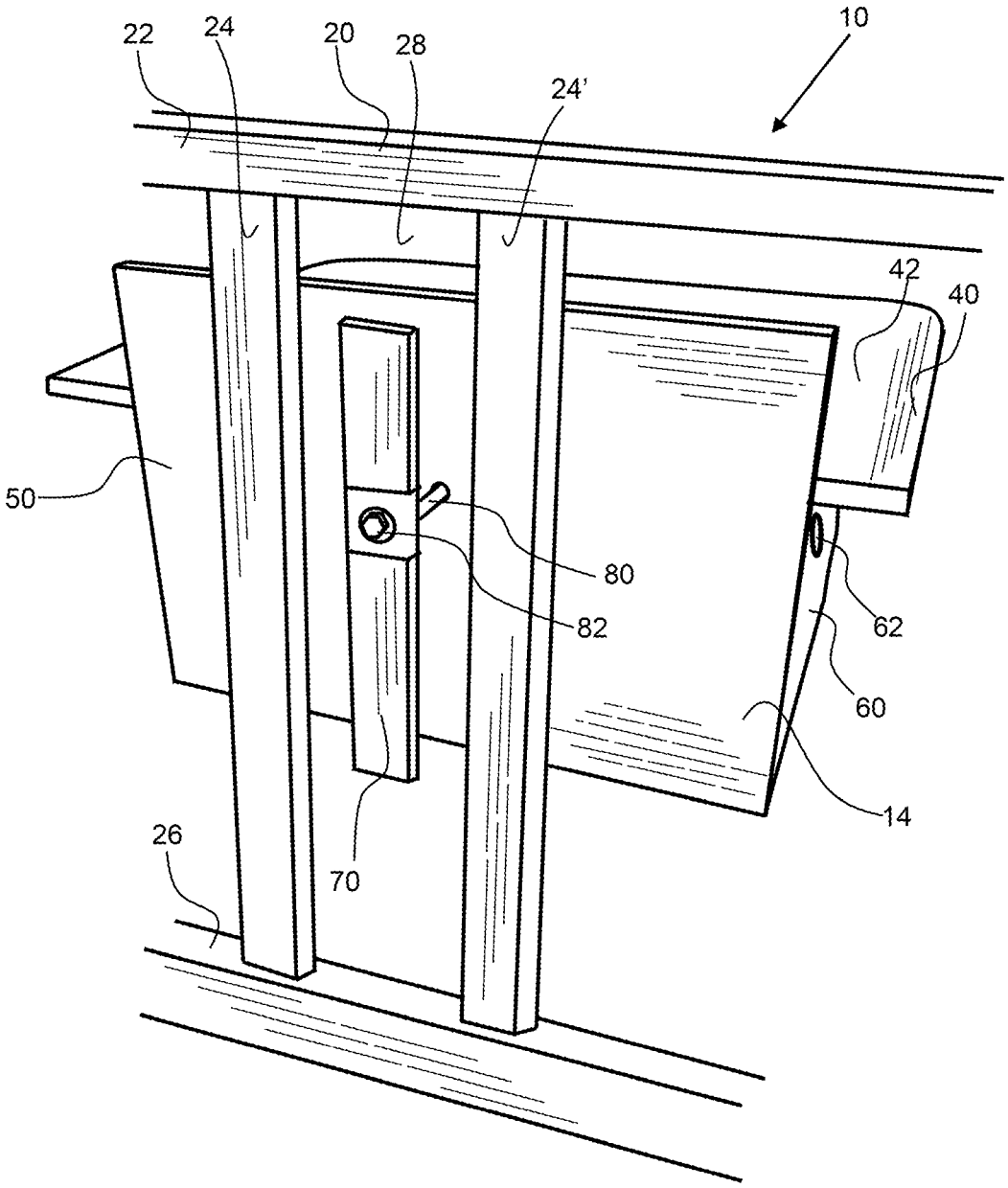
FIG. 4 shows a back perspective view of an exemplary portable rail shelf system with the retainer plate rotated to allow it to extend through a pair of adjacent slats of the rail.
Figure 5:
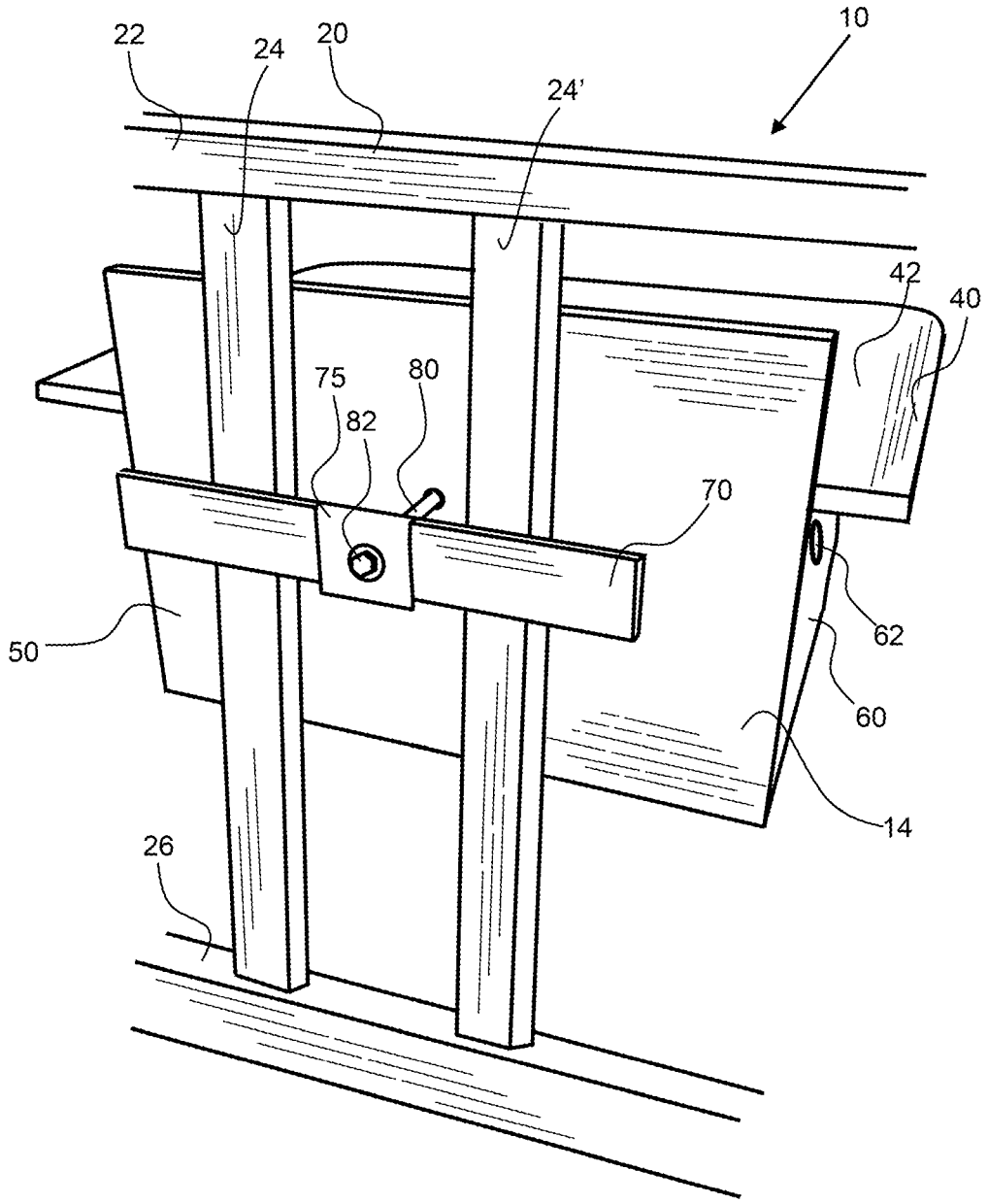
FIG. 5 shows a back perspective view of the exemplary portable rail shelf system shown in FIG. 4, with the retainer plate rotated to extend across the two adjacent slats of the rail.
Figure 7:
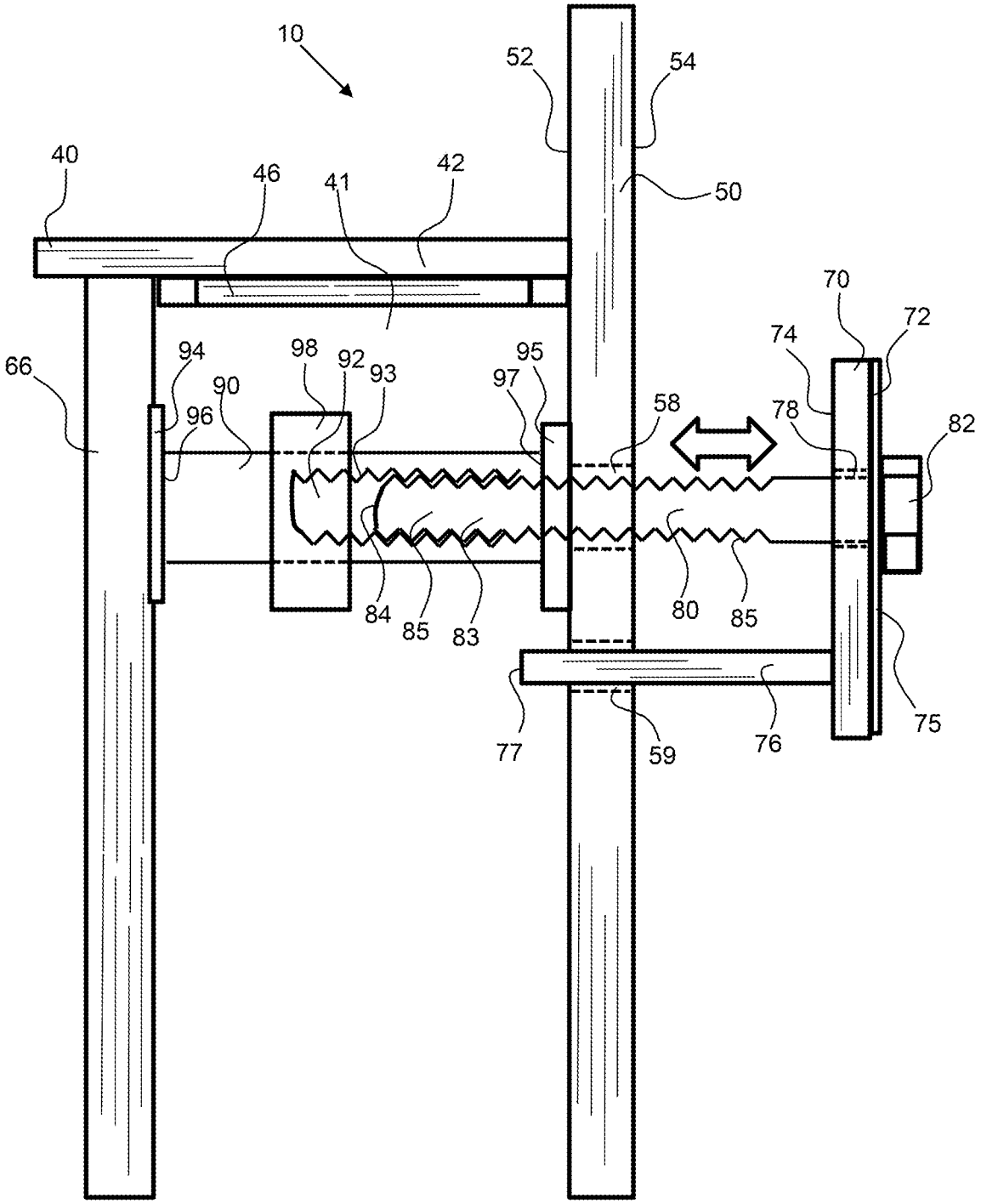
FIG. 7 shows a cross sectional view of an exemplary portable rail shelf system with the retainer bolt extending from the retainer plate, through the shelf back panel and into the bolt receiver aperture of the shelf bolt receiver.

Referring now to FIGS. 4 and 7, and exemplary portable rail shelf system 10 is configured to detachably attach to a rail 20 by clamping the retainer plate 70 onto slats 24, 24' of the rail. The adjacent slats 24, 24' extend vertically between the top rail 22 and the bottom rail 26. As shown in FIG. 4, the retainer plate 70 is configured vertically so it can be passed through the adjacent slats 24, 24'. The retainer plate may be rotated or the portable rail shelf 42 with the retainer plate attached may be rotated to orient the retainer plate 70 for passage through the adjacent slats. As shown in FIG. 5, the retainer plate 70 is now configured horizontally, or orthogonally to the length of the slats. The retainer plate may be configured substantially orthogonal (within 20 degrees or less of orthogonal) to the length direction of the slats to provide effective retention of the portable rail shelf to the rail. The retainer plate 70 may then be pulled toward the slats to clamp the retainer plate to the slats 24, 24'.

Figure 6:
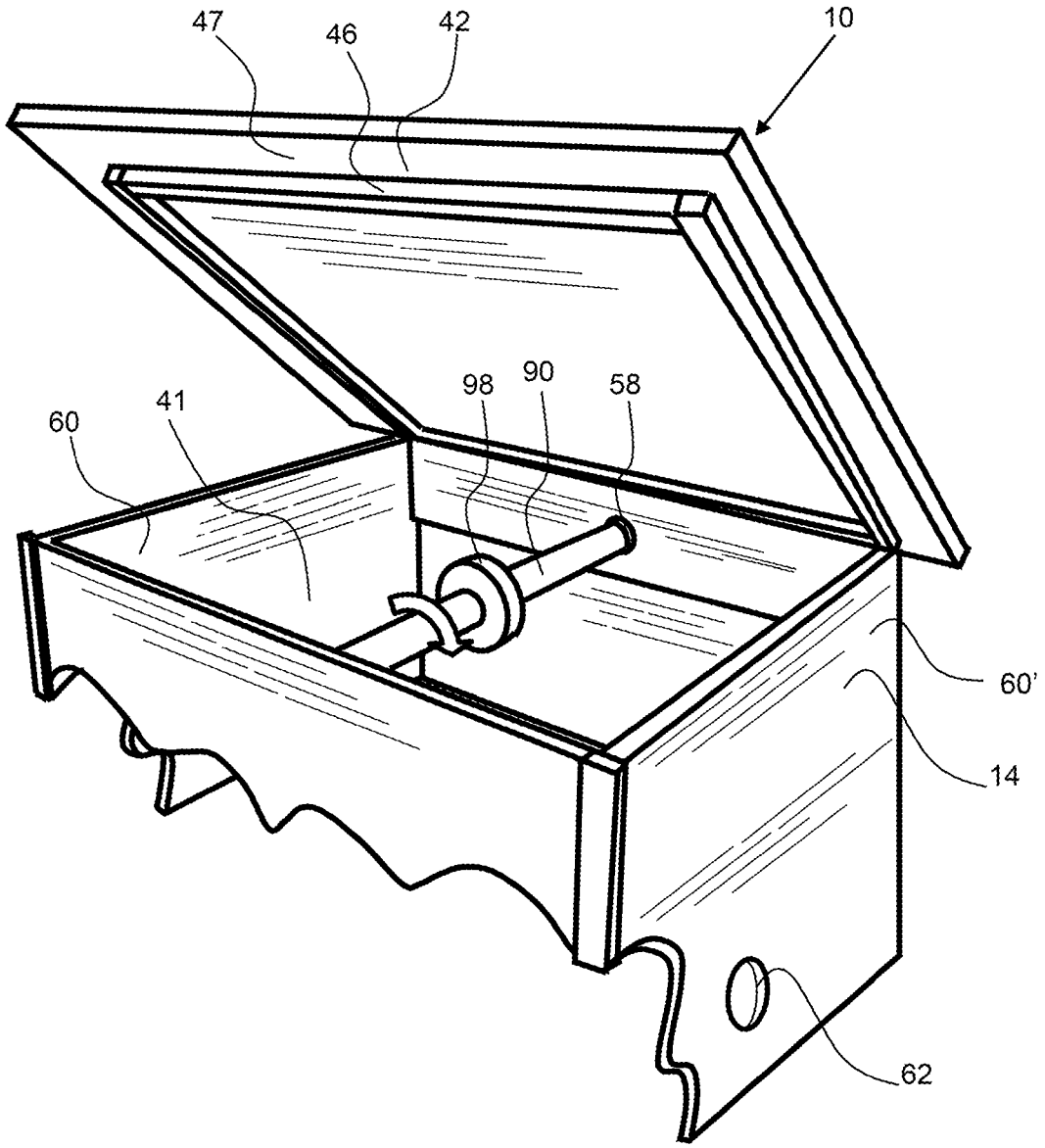
FIG. 6 shows front right side perspective view of an exemplary portable rail shelf system with the shelf panel opened to expose the shelf interior and the shelf bolt receiver extending from the shelf front panel to the shelf back panel.

Referring now to FIGS. 6 and 7, the shelf bolt receiver 90 has receiver threads 93 and receives the retainer bolt 80 and engages with the bolt threads, such that rotation of the shelf bolt receiver actuates the bolt. As shown in FIG. 6, clockwise rotation of the shelf bolt receiver 90 will actuate the retainer bolt 90 toward the shelf back panel 50. The shelf bolt receiver 90 may have a tightening feature 98, such as an extension from the shelf bolt receiver to reduce the torque required to turn the shelf bolt receiver. The tightening feature may include a high friction surface to further aid in rotating the shelf bot receiver 90 without slipping.

As shown in FIG. 7, the retainer bolt 80 has a bolt head 82 configured on the bolt head side 72 of the retainer plate 70 and a bolt extension 83 that extends through the plate bolt aperture 78, past the rail side 74 of the retainer plate, through the shelf bolt aperture 58 in the shelf back panel 50 to a bolt extended end 84. The bolt 80 has bolt threads 85 on the bolt extended end 84 that is configured in the bolt receiver aperture 92 of the shelf bolt receiver 90 and engages with the receiver threads 93. A bolt head plate 75 is configured between the bolt head 82 and the bolt head side 72 of the retainer plate 70. The rotation of the shelf bolt receiver 90 and the receiver threads 93 actuates the retainer bolt 80 and the retainer plate 70 coupled thereto. Rotation of the shelf bolt receiver 90 in a first direction, such as clockwise when viewed from the front of the portable rail shelf 40, actuates the retainer bolt 80 toward the portable rail shelf 40 or shelf back panel 50, and rotation of the shelf bolt receiver 90 in a second direction, such as counter-clockwise when viewed from the front of the portable rail shelf 40, actuates the retainer bolt 80 away from the portable rail shelf 40 or shelf back panel 50, as indicated by the double ended arrow. In this way, the portable rail shelf system 10 and the portable rail shelf 40 is detachably attachable to a rail.

As shown in FIG. 7, the shelf bolt receiver 90 extends from a front end 96 proximal to the shelf front panel 66 to a back end 97, proximal to the shelf back panel 50. A front slip plate 94 and back slip plate 95 prevent the shelf bolt receiver 90 from sticking to the shelf front and back panels and aids in ease of rotation. A back slip plate may be a low friction material.

As shown in FIG. 7, a retainer extension 76 extends from the retainer plate 70 and through a retainer extension aperture 59 in the shelf back panel 50 to the retainer extended end 77 to prevent the portable rail shelf 40 from rotating with respect to the retainer plate 70. The retainer extended end 77 is configured within the shelf interior 41 or from the rail side 54 past the shelf side 52 of the shelf back panel 50. The retainer extension 76 may be detachably attachable to the retainer plate 70.

Figure 8:
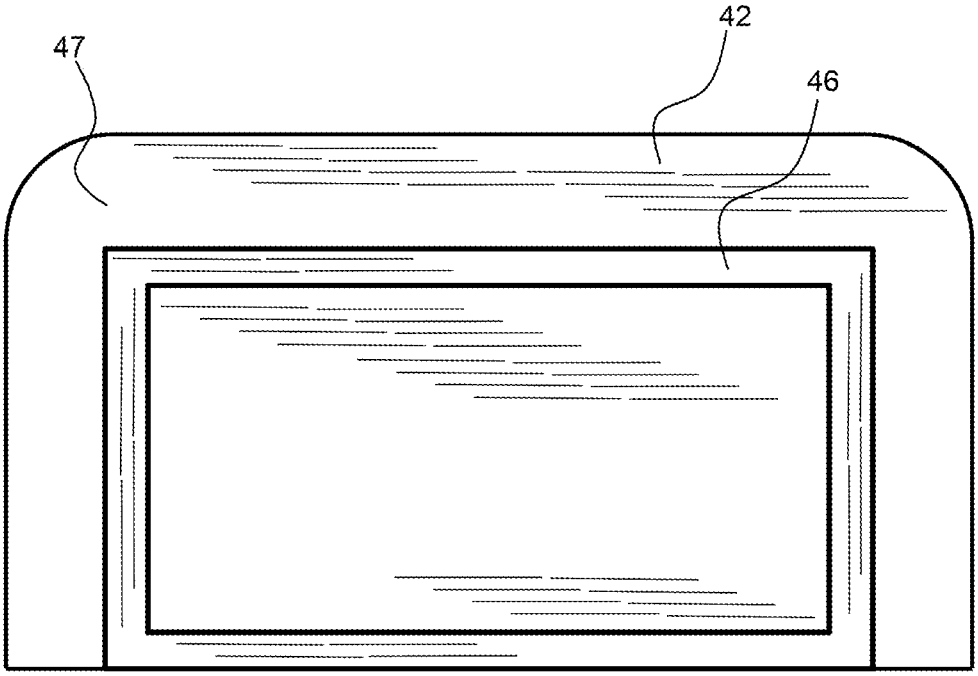
FIG. 8 shows a flange surface view of a shelf panel having a shelf flange extending from the flange surface.
Figure 9:
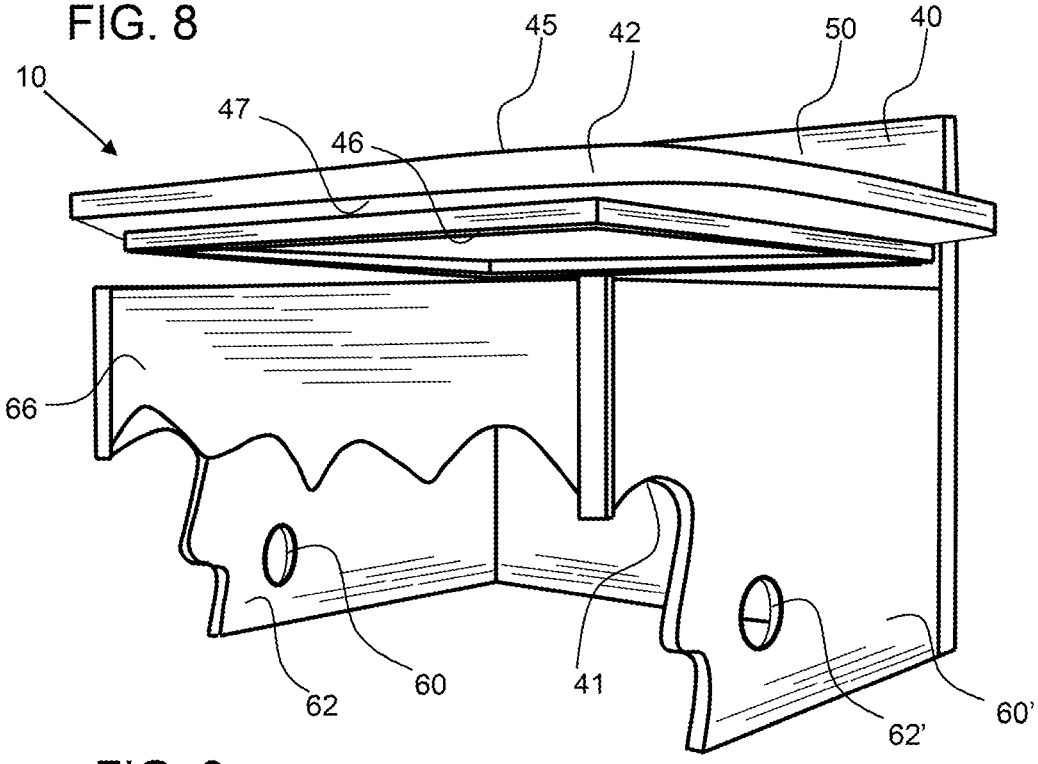
FIG. 9 shows a front right side perspective view of an exemplary portable rail shelf system with the shelf panel lifted up from the portable rail shelf.

Referring now to FIGS. 8 and 9, a shelf flange 46 extends from the flange surface 47 of the shelf panel 42. The flange surface 47 is opposite the shelf surface 45 of the shelf panel 42. The shelf flange 46 has a front extension portion configured to abut against the shelf front panel 66 and two side extension portions configured to abut against the shelf side panels 60, 60'. The shelf flange may fit within the shelf interior 41, or inside of the shelf front and shelf side panels. A back extension of the shelf flange 46 extends against the shelf back panel 50. As shown in FIG. 9, the shelf panel 42 may be configured to detach from the portable rail shelf 40, and may simply lift off from the portable rail shelf.

It will be apparent to those skilled in the art that various modifications, combinations, and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A portable rail shelf system comprising:

a) a portable rail shelf comprising:

i) a shelf back panel comprising:

a shelf side;
a rail side;
a shelf bolt aperture extending through the shelf back panel from the shelf side to the rail side; and
a retainer extension aperture;
ii) shelf sides extending from the shelf side of the shelf back;
iii) a shelf panel extending over the shelf sides; and
iv) a shelf front panel extending between the shelf sides, wherein the shelf sides extend from the shelf back panel to the shelf front panel;

wherein the shelf back panel, shelf sides, shelf front panel and shelf panel form a shelf interior;

b) a shelf bolt receiver having length from a front end to a back end and extending across the shelf interior, wherein said back end is supported by the shelf back panel and said front end is supported by the shelf front panel and wherein said shelf bolt receiver comprises a bolt receiver aperture having receiver threads;

c) a retainer plate comprising:
i) a rail side;
ii) a bolt head side; and
iii) a plate bolt aperture extending through the retainer plate from the rail side to the bolt head side;
iv) a retainer extension that is coupled with the retainer plate and extends through the retainer extension aperture in the shelf back panel to prevent the portable rail shelf from rotating;

d) a retainer bolt comprising:
i) a bolt head configured on bolt head side of the retainer plate;
ii) a bolt extension that extends from the bolt head to an extended end; and
iii) bolt threads configured on the extended end;

wherein said retainer bolt extends through the plate bolt aperture, through the shelf bolt aperture and into said bolt receiver aperture; and wherein the bolt threads are threadedly engaged with the receiver threads;

wherein the shelf bolt receiver is configured to rotate to advance the retainer bolt into the bolt receiver aperture to pull the retainer plate against a rail;

e) a rail comprising:
i) a first slat;
ii) a second slat; and
iii) a slat opening between the first slat and second slat;

wherein each of said first slat and second slat have a slat shelf side and a slat retainer plate side;

wherein the retainer plate is configured on said slat retainer plate side of the first and second slats and whereby rotation of the shelf bolt receiver moves the retainer bolt to actuate the retainer plate toward the retainer back panel and press against the retainer plate side of the first and second slats to retain the portable rail shelf to the rail.

2. The portable rail shelf system of claim 1, wherein the shelf bolt receiver further comprises a tightening feature.

3. The portable rail shelf system of claim 1, wherein the tightening feature is larger in diameter than a diameter of the shelf bolt receiver.

4. The portable rail shelf system of claim 1, wherein the shelf panel is detachably attachable to the portable rail shelf.

5. The portable rail shelf system of claim 4, wherein the shelf panel further comprises a shelf flange configured to abut the shelf side panels and the shelf front panel to retain the shelf panel in position.

6. The portable rail shelf system of claim 1, wherein the shelf panel further comprises a shelf flange configured to abut the shelf side panels and the shelf front panel to retain the shelf panel in position.

7. The portable rail shelf system of claim 1, wherein the shelf panel extends over the shelf side panels an overhang distance of at least 2 cm.

8. The portable rail shelf system of claim 7, wherein the shelf panel extends over the shelf front panel an overhang distance of at least 2 cm.

9. The portable rail shelf system of claim 1, wherein the shelf back panel extends up from the shelf top a back extension height of at least 10 mm.

10. The portable rail shelf system of claim 1, wherein the retainer extension is detachable from the retainer plate.

11. The portable rail shelf system of claim 1, wherein the wherein the retainer bolt and retainer extension are vertically aligned.

12. The portable rail shelf system of claim 1, further comprising a retainer bolt head plate configured between the bolt head side of the retainer plate and the bolt head.

* * * * *